US009731499B2

(12) United States Patent
Telljohann et al.

(10) Patent No.: US 9,731,499 B2
(45) Date of Patent: Aug. 15, 2017

(54) DEVICE FOR ADJUSTING AN OPERATING PARAMETER OF INK FOR A PRINTING PROCESS OF A ROTARY PRINTING PRESS AS WELL AS METHOD THEREFOR

(71) Applicant: Windmoeller & Hoelscher KG, Lengerich (DE)

(72) Inventors: Lutz Telljohann, Lengerich (DE); Frank Hasselmann, Osnabrueck (DE); Andreas Ihme, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 14/398,234

(22) PCT Filed: Mar. 22, 2013

(86) PCT No.: PCT/EP2013/056139
§ 371 (c)(1),
(2) Date: Oct. 31, 2014

(87) PCT Pub. No.: WO2013/164133
PCT Pub. Date: Nov. 7, 2013

(65) Prior Publication Data

US 2015/0107471 A1 Apr. 23, 2015

(30) Foreign Application Priority Data

May 2, 2012 (DE) ..... 10 2012 103 850

(51) Int. Cl.
*B41F 31/06* (2006.01)
*B41F 31/08* (2006.01)
(Continued)

(52) U.S. Cl.
CPC ..... *B41F 31/06* (2013.01); *B41F 31/005* (2013.01); *B41F 31/027* (2013.01); *B41F 31/08* (2013.01); *B41P 2233/11* (2013.01)

(58) Field of Classification Search
CPC ..... B41F 31/005; B41F 31/027; B41F 31/08; B41F 35/04; B41P 2233/11; B41P 2231/20; B41P 2231/21
See application file for complete search history.

(56) References Cited

U.S. PATENT DOCUMENTS 4,362,179 A 12/1982 MacPhee et al.
5,816,163 A 10/1998 Achelpohl et al.
(Continued)

FOREIGN PATENT DOCUMENTS

DE 19548535 7/1997
EP 0970809 1/2000
(Continued)

*Primary Examiner* — Jennifer Simmons
*Assistant Examiner* — Leo T Hinze
(74) *Attorney, Agent, or Firm* — Jacobson Holman, PLLC.

(57) ABSTRACT

A device for setting at least one operating parameter of ink for a printing process of a rotary printing press having an inking system which has a doctor blade device with a doctor blade chamber containing the ink for the printing process, and an ink reservoir from which ink can be supplied to the doctor blade chamber, includes a supply system which allows ink to be supplied inside the inking system. The supply system can be switched to a setting mode (I) or to a production mode (II), the operating parameter being automatically set in the setting mode (I) and no ink being supplied to the doctor blade chamber, and the supply system supplying ink to the doctor blade chamber in the production mode (II).

15 Claims, 2 Drawing Sheets

(51) Int. Cl.
*B41F 31/00* (2006.01)
*B41F 31/02* (2006.01)

(56) References Cited

U.S. PATENT DOCUMENTS

| | | | | | |
|---|---|---|---|---|---|
| 5,974,817 | A * | 11/1999 | Prummer | B41F 7/24 | 101/487 |
| 6,901,861 | B2 * | 6/2005 | Adachi | B41F 31/005 | 101/350.1 |
| 7,159,518 | B2 * | 1/2007 | Haas | B41F 33/0054 | 101/480 |
| 7,555,982 | B2 * | 7/2009 | Telljohann | B41F 31/027 | 101/350.6 |
| 7,641,448 | B2 * | 1/2010 | Gydesen | B41F 31/027 | 137/209 |
| 8,915,186 | B2 * | 12/2014 | Nadachi | B41F 35/04 | 101/423 |
| 2005/0103217 | A1 * | 5/2005 | Biasini | B41F 31/027 | 101/425 |
| 2008/0210114 | A1 * | 9/2008 | Ning | B41F 31/022 | 101/484 |

FOREIGN PATENT DOCUMENTS

| | | | | |
|---|---|---|---|---|
| EP | 1 932 669 | | 6/2008 | |
| GB | 1 057 749 | | 2/1967 | |
| GB | 2 084 079 | | 4/1982 | |
| JP | WO 2011055679 | A1 * | 5/2011 | B42F 35/04 |
| WO | WO 99/11459 | | 3/1999 | |

* cited by examiner

DEVICE FOR ADJUSTING AN OPERATING PARAMETER OF INK FOR A PRINTING PROCESS OF A ROTARY PRINTING PRESS AS WELL AS METHOD THEREFOR

CROSS-REFERENCE TO RELATED APPLICATIONS

This is a national stage of PCT/EP2013/056139, published in German.

BACKGROUND OF THE INVENTION

1. Field of Invention

The invention relates to a device for adjusting at least one operating parameter of ink for a printing process of a rotary printing press, comprising a color system, which shows a doctor device with a doctor chamber, in which ink is contained for the printing process, and an ink reservoir, from which the ink can be conveyed into the doctor chamber, a conveyance system which allows to convey the ink within the color system. Additionally the invention relates to a method for operating the above-mentioned device.

2. Description of the Prior Art

DE 195 48 535 A1 describes a rotary printing press comprising a doctor device with a doctor chamber, with it being possible for ink to be conveyed via supply lines and drainage lines into the doctor chamber and out of the doctor chamber, respectively.

Here, the device comprises appropriate pumps with valves, which connect the doctor chamber to an ink reservoir. It has shown that at the beginning of a printing process as well as during the printing process of a rotary printing press the operating parameters of the ink must be monitored and/or adjusted in order to ensure high quality of the printing process. It has shown, among other things that the ink needs to maintain a defined viscosity for yielding a flawless quality during the printing process, it has shown, among other things that due to evaporation effects the ratio of solvent in the ink can change, leading to major influences upon viscosity.

It is known from prior art to manually take an ink sample from the ink reservoir, based on which the viscosity of the ink is then determined. This monitoring process is disadvantageous in the fact that it is very time consuming.

SUMMARY OF THE INVENTION

The objective of the present invention is to avoid the above-mentioned disadvantages, particularly to provide a device and a method for adjusting at least one operating parameter of an ink for a printing process of a rotary printing press, with it being possible to keep as short as possible the time for adjusting the operating parameter and simultaneously to keep low the structural expense of the necessary equipment.

The objective of the present invention is attained in all features described herein.

It is provided according to the invention that the conveyance system is embodied such that the conveyance system can be switched to an adjustment mode and to a production mode, with it being possible to perform an automatic adjustment of the operating parameter in the adjustment mode and any conveyance of the ink into the doctor chamber being prevented, and in the production mode the conveyance system conveying ink into the doctor chamber. An essential core of the invention is the fact that in the adjustment mode the doctor chamber is not supplied with ink.

This way it is possible that during this adjustment period, for example maintenance tasks can be performed at the doctor device and/or at the doctor chamber. Simultaneously, a respective adjustment occurs of the operating parameter or parameters of the ink. This represents a considerable time saving during the set-up time of the apparatus according to the invention. Thus, the rollers arranged at the doctor device can be serviced, exchanged, and simultaneously for the upcoming printing process here ahead an appropriate adjustment of the operating parameter or parameters of the ink can occur at the same time. An important operating parameter is here the viscosity of the ink. Via the supply of solvent and/or the change of the temperature of the ink, here the viscosity of said ink can be considerably influenced. As long as the operating parameter fails to show the desired value, the device according to the invention remains in its adjustment mode. Only when the operating parameter has reached the desired value an automatic switching occurs of the conveyance system into its production mode, in which the ink is conveyed with the desired operating parameter into the doctor chamber so that simultaneously the rotary printing press can execute its printing process. It is also possible that the switching from the adjustment mode into the production manner occurs in a mode other than automatic. For example it may be provided that a switching from the adjustment mode into the production mode occurs manually, before the actual printing process of the rotary printing press occurs.

According to the invention it may be provided that the conveyance system for the doctor chamber comprises a primary supply line and a primary drainage line, with the conveyance system comprising at least one pump, which shows the primary supply line and the primary drainage line, and a bypass line being arranged between the doctor chamber and the pump. Advantageously the primary supply line may show a flow pump and the primary drainage line show a return flow pump. Here, the device according to the invention may comprise a conveyance system with a production circuit for the production mode and an adjustment circuit for the adjustment mode. As long as ink is conveyed through the adjustment circuit said production circuit is blocked and/or closed for the ink. The opening and closing of the two above-mentioned circuits can advantageously occur via valves, which are arranged at least partially in the primary supply line and/or in the primary drainage line.

During the production circuit only one pump can be fully active, which ensures that the ink is conveyed within the production circuit, particularly conveyed from the ink reservoir to the doctor chamber and hack. It may also be provided in the adjustment mode that only one pump is provided and/or active in order to allow the ink flowing within the adjustment circuit. Alternatively it is possible that both pumps, particularly the flow pump and the return flow pump are active, which in the production circuit and/or in the adjustment circuit ensure a satisfactory conveyance of the ink from the ink reservoir to the doctor chamber and back.

In a measure improving the invention, the bypass line may be blocked in the production mode and the bypass line may be open in the adjustment mode. Advantageously, the bypass line may show a valve in order to block the bypass line in the production mode. The invention also includes the option that both, the primary supply line as well as the primary drainage line, are provided with valves, which in the adjustment mode prevent any influx of ink into the doctor chamber.

Additionally, the invention may show a supply station, thus allowing an operating means to be introduced into the adjustment circuit in order to adjust and/or change the operating parameter, with particularly the operating means representing a solvent. Additionally the invention includes the option that the supply station can introduce the operating means into the production circuit. This means that an operating means can be introduced into the conveyance system in the production mode as well, in order to control and influence the value of the operating parameter also during the printing process of the rotary printing press, i.e. online during the printing process of the rotary printing press. This means that at the beginning of each printing process first the doctor chamber is blocked towards the conveyance system, to prevent that any ink can flow into the doctor chamber. Here a conveyance of ink occurs only within the adjustment circuit, with simultaneously it being possible for the supply station to influence the value of the operating parameter via the addition of the operating means. Once the operating parameter of the ink has been adjusted, a switching occurs of the conveyance system into the production mode, in which the bypass line is blocked. In the production mode now the color system may show at least one monitoring means, which checks and/or measures and/or determines the operating parameter of the ink.

While the ink can flow within the production circuit, the supply station can ensure that a certain portion of operating means is introduced into the conveyance system in order to maintain a desired value of the operating parameter for the ink and/or avoid exceeding or falling short thereof.

According to the invention there is the option that at least one monitoring means is integrated in the conveyance system. It may also be provided that several monitoring means are arranged in or at the color system in order to monitor and/or measure or determine the operating parameter. For example it is possible that a monitoring means measures and/or determines the viscosity of the ink. Further, the invention includes a monitoring means, which determines the temperature of the ink, present within the color system, particularly in the ink reservoir, in the primary supply line, in the primary drainage line, in the bypass line, and/or in the doctor chamber. Additionally the invention includes a monitoring means, which is embodied as an ultrasound sensor in order to determine the viscosity of the ink. Additionally, a monitoring means may be integrated in the color system and/or the conveyance system, which is embodied as a temperature sensor.

Additionally the device according to the invention may show a conveyance system with an ink tempering, with particularly the ink tempering being arranged in the primary drainage line. The ink tempering may be embodied as a heat exchanger, for example, which is arranged at the pressure side of the return flow pump. Advantageously the heat exchanger represents a counter flow heat exchanger, with here for example heated water being guided in the primary drainage line opposite the flow direction of the ink. Via heat dissipation from the water to the ink then a defined ink tempering occurs, which is necessary during the printing process in a rotary printing press in order to allow achieving a high quality of the color printing. For this purpose, the viscosity of the ink may also be adjusted.

Further it is possible that the flow pump of the primary supply line at its pressure side comprises a supply line to the doctor chamber, with this supply line being a component of the primary supply line, which extends between the ink reservoir and the doctor chamber. Another supply line is provided at the suction side of the flow pump, which connects the ink reservoir to the flow pump. Advantageously the supply line may show a valve at the suction side of the flow pump, which is switched between the flow pump and the ink reservoir; the supply line at the pressure side of the flow pump may also be equipped with a valve which is switched between the doctor chamber and the flow pump.

Additionally it is possible that the primary drainage line comprises a drainage line, which is arranged at the suction side of the return flow pump. This drainage line may show a valve between the return flow pump and the doctor chamber. Additionally the primary drainage line may show another drainage line at the pressure side of the return flow pump, with that lattermost drainage line perhaps comprising a valve between the ink reservoir and the return flow pump. This way it is possible that a circuit can be provided such that ink from the ink reservoir can be pumped by the flow pump into the doctor chamber, with subsequently it being possible that ink is conveyed back into the ink reservoir by the return flow pump. This circuit represents the production circuit. It represents the normal inking process for the doctor device, particularly for the anilox roll of the rotary printing press. The valves provided between the doctor chamber and the two pumps may be switched for example such, particularly closed, that a fluid flow develops from the flow pump in the direction towards the return flow pump only through the bypass line. This blockage of the doctor chamber may be important, for example, when the conveyance system is set in the adjustment mode.

According to the invention it may be provided that in the adjustment mode only the return flow pump is active, which ensures that the ink is conveyed from the primary supply line through the bypass line into the primary drainage line in the direction towards the ink reservoir. This shall prevent that, in case of a potentially slightly leaking valve located in the primary supply line, namely between the flow pump and the doctor chamber, any ink can enter the doctor chamber. This way the line represents the suction side of the return flow pump, downstream the flow pump and the bypass line, preventing any influx of ink through a potential leak of the valve located between the flow pump and the doctor chamber.

Alternatively it is also possible that in the adjustment mode during the conveyance of the ink both the flow pump and the return flow pump are active, with simultaneously the valves arranged between the two pumps and the doctor chamber being closed in order to prevent any penetration of ink into the doctor chamber. The bypass line is therefore open, which allows ink flowing from the primary supply line via the bypass line into the primary drainage line in the direction towards the ink reservoir and back. Alternatively it is also possible that the flow pump for the ink conveyance is activated in the adjustment mode, in order to allow ink to flow via the bypass line to the deactivated return flow pump, with the ink being conveyed through the primary drainage line and simultaneously through the return flow pump in the direction towards the ink reservoir.

Further, the invention includes a method for adjusting at least one operating parameter of ink for a printing process of a rotary printing press, comprising a color system, including a doctor device with a doctor chamber, in which ink is contained for the printing process, and an ink reservoir, from which the ink can be conveyed to the doctor chamber, a conveyance system which allows the conveyance of the ink within the color system. According to the invention the conveyance system is embodied such that the conveyance system can be switched to an adjustment mode and to a production mode, with in the adjustment mode an automatic adjustment of the operating parameter being performed and the access of ink to the doctor chamber being blocked, and in the production mode the conveyance system conveying ink into the doctor chamber.

Advantageously the conveyance system comprises a production circuit for the production mode and an adjustment circuit for the adjustment mode, which are particularly operated separately from each other. Here it is possible that at least partially the production circuit is equivalent to the adjustment circuit. Both of these circuits can be switched by valves such that either the production circuit or the adjustment circuit is activated.

For example, the operating parameter may represent and/or define the viscosity of the ink, which is adjusted in the adjustment mode, in the production mode the conveyance system may be embodied such that simultaneously the operating parameter is controlled and/or checked. For this purpose the color system may comprise at least one monitoring means, which checks the operating parameter in the adjustment mode and/or in the production mode. According to the invention it is possible that the conveyance system comprises a supply station, by which an operating means is inserted into the adjustment circuit when a target value of the operating parameter is not complied with, particularly when a target value of the operating parameter is fallen short or is exceeded. The supply station can here be integrated in the conveyance system such that an operating means is inserted into the production circuit even during the production mode, when a target value of the operating parameter is not complied with, particularly when a target value of the operating parameter is fallen short or is exceeded. Advantageously the location for inserting the operating means is the same for both the production mode as well as the adjustment mode.

The invention includes that the conveyance system for the doctor chamber comprises a primary supply line and a primary drainage line, with the conveyance system comprising at least one pump, which comprises the primary supply line or the primary drainage line, a bypass line being arranged between the doctor chamber and the pump, particularly the operating means being fed to the primary drainage line, and a mixing of the operating means with the ink being performed in the ink reservoir. The supply of the operating means can alternatively also occur directly into the ink reservoir. An appropriate mixing occurs in the ink reservoir, for example via a mixer or an agitator, regardless if the operating means is supplied to the ink outside the ink reservoir or directly at the ink reservoir. The ink is conveyed via the pump and/or pumps within the production circuit and/or the adjustment circuit, with simultaneously the monitoring means checking the operating parameter of the ink, in general it is beneficial for the monitoring means to be arranged at the suction side of the flow pump, i.e. between the flow pump and the ink reservoir at the primary supply line. It is also possible for the monitoring means to be arranged at the pressure side of the flow pump.

Advantageously the monitoring means can measure and/or monitor the viscosity and/or the temperature of the ink, with the monitoring means performing the measurement and/or the monitoring of the ink in the adjustment mode and/or in the production mode. Advantageously the device according to the invention may show a control and/or regulating unit, which receives the values of the monitoring means and accordingly addresses the supply station and/or the ink tempering, if here a change of the operating parameter is necessary.

Additionally it is possible that the conveyance system comprises a cleaning device, which allows a cleaning solution to flow into the conveyance system for cleaning the color system. If the actual printing process is concluded, the color system including the doctor device, doctor chamber, lines of the conveyance system, pumps, and the ink reservoir can be washed and/or cleaned by the cleaning solution using the cleaning device. For this purpose it is possible that the color system is connected to a storage container, into which the ink can be pumped from the color system, before cleaning solution is inserted from a solvent container into the color system in order to clean said color system from any ink. Subsequently the cleaning solution soiled by the ink can be pumped into the refuse container, which is also connected via lines to the conveyance system.

The adjustment of the viscosity can occur e.g., in at least two steps:

- overcoming the thixotropy by preliminary pumping, i.e. with the help of pumps present within the conveyance system
- adjusting and/or changing the viscosity by inserting solvent only after overcoming thixotropy The rotary printing press may show a plurality of color systems and/or conveyance systems. When one color system is not involved in the printing process of the rotary printing press it may be provided according to the invention that the pump(s) is/are operated with reduced power and/or with reduced pumping frequency, with the thixotropy of the ink remaining overcome.

BRIEF DESCRIPTION OF THE DRAWINGS

Additional advantages and details are discernible from the following description, in which an exemplary embodiment of the invention is described in detail with reference to the drawings. Here, the features mentioned in the claims and in the description may be individually essential for the invention or in any arbitrary combination. It shows:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
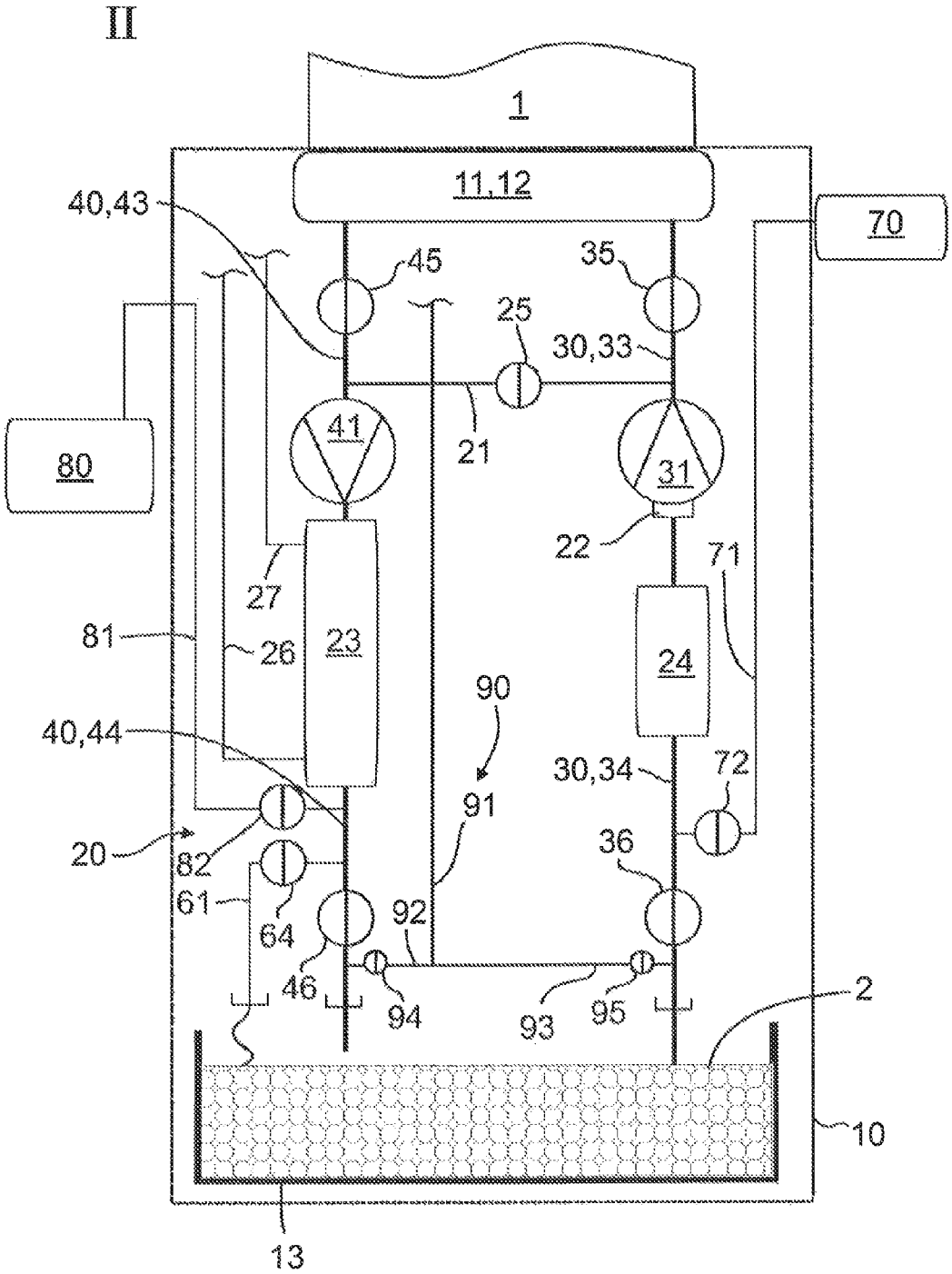
FIG. 1 a device for adjusting at least one operating parameter of ink for a printing process of a rotary printing press, in which a doctor device with its doctor chamber is inked, and FIG. 2 the device according to FIG. 1, with a conveyance of the ink into the doctor chamber being blocked.
Figure 2:
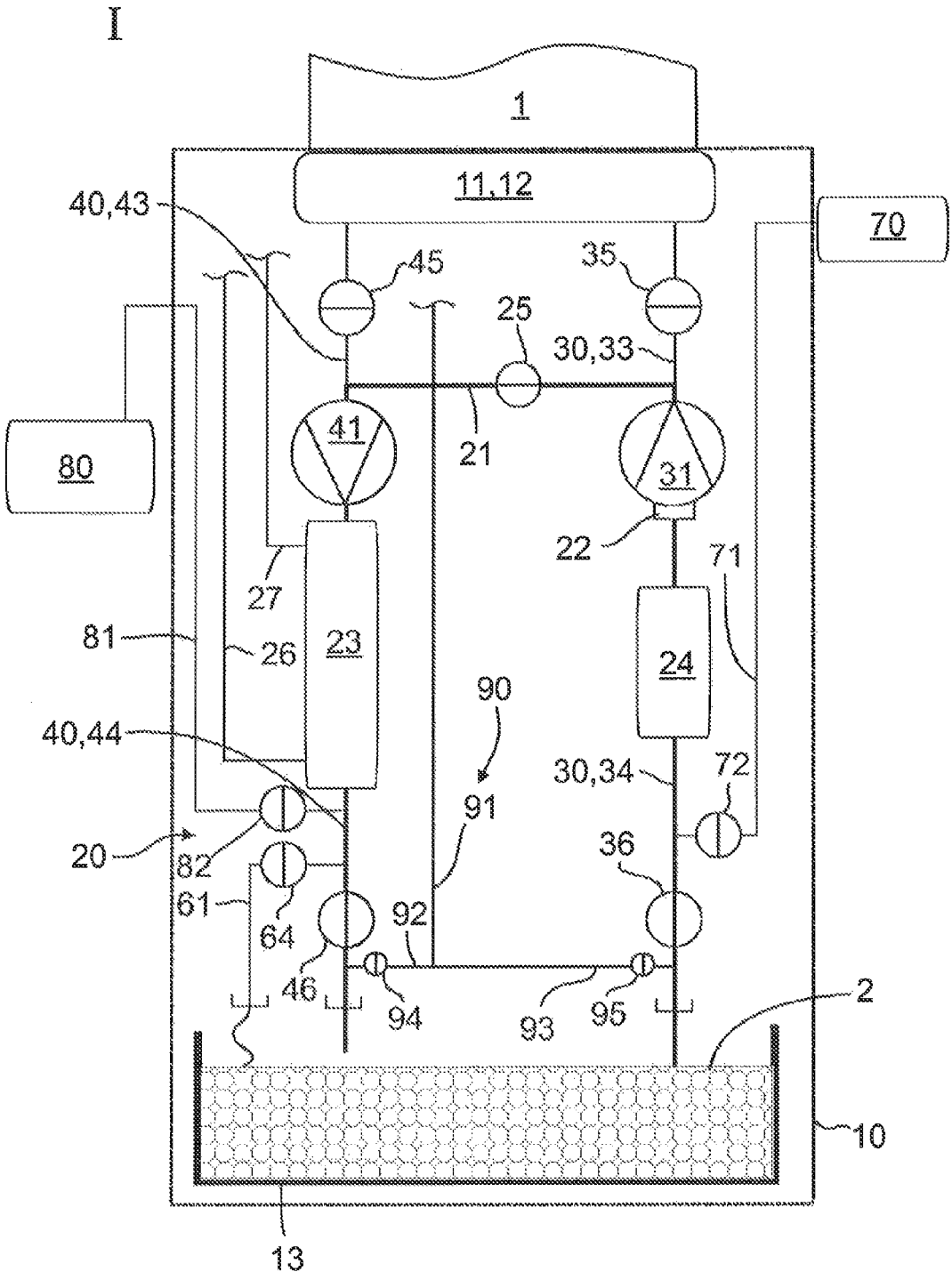

FIGS. 1 and 2 show a potential exemplary embodiment of a color system 10, which is arranged in a rotary printing press 1. Here, the color system 10 is primarily provided for the purpose to supply the doctor device 11 with the respective ink 2 during the printing process of the rotary printing press 1. The doctor device 11 comprises here a doctor chamber 12, in which the respective quantity of ink is provided by the color system 10. Ink 2 is transferred by an appropriate embodiment of the doctor device 11 from the doctor chamber 12 to an appropriate printing unit, ensuring the printing operation of the rotary printing press 1.

In order to provide the ink 2 during the normal printing process the color system comprises an ink reservoir 13, in which the ink 2 is contained. Additionally, a conveyance system 20 is located between the doctor device 11 and the ink reservoir 13, which is a component of the color system 10. The conveyance system 20 comprises various pumps 31, 41, lines 30, 40, as well as valves, so that a circuit develops for the ink 2 from the ink reservoir 13 to the doctor device 11 and back to the ink reservoir 13. During the printing process according to FIG. 1 the ink 2 flows through the primary supply line 30, with the flow pump 31 being activated, and the ink 2 flows through the supply line 33, 34. Here the primary supply line 30 comprises two valves 35, 36, with both valves 35, 36 being open.

As discernible from the two figures, the conveyance system 20 comprises a bypass line 21 with a valve 25, with the bypass line 21 connecting the primary supply line 30 to the primary drainage line 40. According to FIG. 1 the valve 25 is closed, so that a circulation of the ink 2 occurs only via the doctor chamber 12. During the printing processes of the rotary printing press 1 the return flow pump 41 is also activated, so that the drainage line 43 represents the suction side of the return flow pump 41 and the drainage line 44 represents the pressure side of the return flow pump 41. Additionally the primary drainage line 40 comprises two valves 45, 46, which are open during the printing process according to FIG. 1.

The conveyance system 20 is embodied such that the conveyance system 20 can be switched to an adjustment mode I and a production mode II. The adjustment mode I is shown in FIG. 2. FIG. 1 shows the production mode II. In the production mode I the conveyance system 20 generates a production circuit, which leads from the ink reservoir 13 through the primary supply line 30, through the doctor chamber 12, and through the primary drainage line 40, back to the ink reservoir 13. An adjustment circuit develops in the adjustment mode I for the ink 2, namely the ink 2 is conveyed by the conveyance system from the ink reservoir 13 through the primary supply line 30, through the bypass line 21, through the primary drainage line 40, back into the ink reservoir 13. In the adjustment mode II the valve 25 is open, while the valves 45, 35 are closed. The valves 46, 36 are both open in the adjustment mode II as well as in the production mode I, so that an open circuit is ensured for the ink 2.

In order to allow executing a pre-conditioning of the printing ink for the printing process of the rotary printing press 1, first an adjustment occurs of at least one operating parameter of the printing ink 2, in order to ensure a high quality printing process in the production mode of the conveyance system 20. In particular it has shown that the operating parameter viscosity is of major importance. The color system 10 comprises monitoring means 22, 24 with the monitoring means 24 monitoring the viscosity of the ink. However the monitoring means 22 can (also) determine and/or monitor the temperature of the ink 2. In the present exemplary embodiment both monitoring means 22, 24 are arranged in the primary supply line 30. The monitoring means 24 can also be arranged downstream the flow pump 31 but upstream in reference to the bypass line 21. In the present exemplary embodiment the monitoring means 24 is an ultrasound sensor. However, the monitoring means 22 is embodied as a temperature sensor. The monitoring means 22, 24 may also be combined in an assembly. In the adjustment mode I according to FIG. 2 the operating parameter, particularly the viscosity, is being adjusted until the target viscosity is reached. The influencing of the viscosity occurs here by the supply station 90 adding operating means. The supply station 90 comprises lines 91, 92, 93, with the line 92 showing a valve 94 and the line 93 a valve 95. When now operating means is supplied via the supply station 90 into the conveyance system, particularly solvent, the valve 94 is in the open position (which is explicitly not shown). The valve 95 remains in the closed position. Simultaneously the valve 46 of the primary drainage line 40 is in its closed position. This way it is intended for the solvent to be conveyed directly to the ink reservoir 13. Here, mixing occurs, for example by a mixer or an agitator. While the ink 2 continues to be conveyed in the adjustment circuit the monitoring means 24 checks the viscosity of the ink 2. The viscosity of the ink 2 can also be influenced by an additional adjustment of the temperature using the ink tempering 23. Only when the target viscosity has been reached, the conveyance system 20 is switched from the adjustment mode I into the production mode II, which is shown in FIG. 1. Here the valve 25 is closed so that ink 2 cannot flow through the bypass line 21. Simultaneously the valves 35, 45 are open, so that the ink can flow in the production circuit.

In the production mode II, further monitoring occurs of the viscosity of the ink 2, namely via the monitoring means 24, 22. If now in the production mode II the operating parameter was not in compliance with the target parameter, an appropriate introduction of the solvent occurs by the supply station 90 into the conveyance system 20, allowing the respective influencing of the viscosity. Here, the bypass line 21 remains blocked.

Additionally the conveyance system 20 comprises a cleaning device 70, which allows a cleaning solution to flow into the conveyance system 20 for cleaning the color system 10. The cleaning device 70 comprises a line 71 with a valve 72, which is closed according to FIGS. 1 and 2. Additionally the device according to the invention shows the option to pump the ink 2 out of the conveyance system 20 after the printing process, with the line 61 with a valve 64 being provided for this purpose, arranged at the primary drainage line 40. When now the ink 2 shall be removed from the color system 10 the valve 64 is opened, with simultaneously the valve 46 according to FIG. 1 being closed. The bypass line 21 remains closed. The ink 2 can be pumped out of the color system 10 by at least one pump 31, 41, with the line 61 being guided into a container, not shown in greater detail, in order to fill this container with ink 2. Thereafter it is possible to convey the cleaning solution from the container 70 into the conveyance system 20, with here it being necessary to open the valve 72. Thus the conveyance system 20 and/or the color system 10 can be washed completely with the cleaning solution, with it here being necessary to open and/or close the respective valves inside the conveyance system 20 so that all essential lines can be washed with the cleaning solution. The ink reservoir 13 can serve as a collection vessel for the cleaning solution enriched with ink residue. After the cleaning process, by opening the valve 82 and closing the valve 46, the soiled cleaning solution can be pumped out of the ink reservoir 13 into a refuse container 80. Advantageously, the valve 35 and the valve 45 should be closed during the process of pumping out, so that via the open valve 25 the cleaning solution enriched with the ink reaches the refuse container 80.

The exemplary embodiment shown may comprise a control and/or regulation unit, not shown in greater detail, which automatically activates the switch of the conveyance system 20 into its adjustment mode and/or its production mode II and/or activates the cleaning of the conveyance system 20 by the cleaning solution or the process of pumping out the soiled cleaning solution. It is also possible that manually the adjustment mode I, the production mode II, the cleaning process, or the process of pumping out is activated and/or deactivated.

In the present exemplary embodiment the ink tempering 23 represents a heat exchanger, comprising a water supply line 26 and a water return line 27. The ink flow in the primary drainage line 40 is aligned opposite in reference to the water flow of the heat exchanger 23.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference characters | |
|---|---|
| 1 | Rotary printing press |
| 2 | Ink |
| 10 | Color system |
| 11 | Doctor device |
| 12 | Doctor chamber |
| 13 | Ink reservoir |
| 20 | Conveyance system |
| 21 | Bypass line |
| 22 | Monitoring means, temperature sensor |
| 23 | Ink tempering, heat exchanger |
| 24 | Viscosity meter, monitoring means |
| 25 | Valve |
| 26 | Water supply line |
| 27 | Water return line |
| 30 | Primary supply line |
| 31 | Flow pump |
| 33 | Supply line |
| 34 | Supply line |
| 35 | Valve |
| 36 | Valve |
| 40 | Primary drainage line |
| 41 | Return flow pump |
| 43 | Drainage line |
| 44 | Drainage line |
| 45 | Valve |
| 46 | valve |
| 61 | Line |
| 64 | Valve |
| 70 | Container for cleaning solution |
| 71 | Solvent supply line |
| 72 | Valve |
| 80 | Refuse container |
| 81 | Supply line |
| 82 | Valve |
| 90 | Supply station |
| 91 | Line |
| 92 | Line |
| 93 | Line |
| 94 | Valve |
| 95 | Valve |
| I | Adjustment mode |
| II | Production mode |

What is claimed is:

1. A device for adjusting an operating parameter of an ink for a printing process of a rotary printing press, comprising:

a color system, which includes a doctor device with a doctor chamber in which the ink is contained for the printing process, an ink container from which the ink is conveyed into the doctor chamber, and a conveyance system, which allows conveyance of the ink within the color system, the conveyance system including a primary supply line and a primary drainage line, a flow pump in the primary supply line and a return flow pump in the primary drainage line, a bypass line connecting the primary supply line to the primary drainage line, the bypass line being arranged between the flow pump and the doctor chamber, and between the doctor chamber and the return flow pump, and an ink tempering element arranged in the primary drainage line, the conveyance system providing an adjustment circuit for an adjustment mode (I) and a production circuit for a production mode (II), and being configured for switching into the adjustment mode (I) and the production mode (II), with, in the adjustment mode (I), the conveyance of the ink into the doctor chamber being prevented via use of the bypass line and an automatic adjustment of the operating parameter being performed, in the production mode (II), the conveyance system conveying the ink into the doctor chamber, the color system including a monitoring element to monitor the operating parameter in the adjustment mode (I) and in the production mode (II), with the monitoring element being arranged in the primary supply line, and measuring and/or determining a viscosity of the ink and/or a temperature of the ink, and the conveyance system including a supply station via which an operating modifier is introduced into the adjustment circuit in order to adjust and/or change the operating parameter.

2. The device according to claim 1, wherein in the production mode (II), the bypass line is blocked and in the adjustment mode (I), the bypass line is opened.

3. The device according to claim 1, wherein the monitoring element is at least one of an ultrasound sensor and a temperature sensor.

4. The device according to claim 1, wherein the operating modifier is a solvent.

5. The device according to claim 1, further comprising a plurality of valves, including a first valve positioned in the primary supply line between the bypass line and the doctor chamber, a second valve positioned in the bypass line, and a third valve positioned in the primary drainage line between the doctor chamber and the bypass line.

6. The device according to claim 1, wherein the ink tempering element is a heat exchanger.

7. The device according to claim 6, wherein the heat exchanger includes a water supply line and a water return line.

8. The device according to claim 7, wherein the water supply line and the primary drainage line are configured to provide for countercurrent flow of water from the water supply line and ink from the primary drainage line.

9. A method of adjusting an operating parameter of an ink for a printing process of a rotary printing press having a color system, which includes a doctor device with a doctor chamber in which the ink is contained for the printing process, an ink reservoir, from which the ink is conveyed into the doctor chamber, and a conveyance system for conveying the ink within the color system, the conveyance system including a primary supply line and a primary drainage line, a flow pump in the primary supply line and a return flow pump in the primary drainage line, a bypass line connecting the primary supply line to the primary drainage line, the bypass line being arranged between the flow pump and the doctor chamber, and between the doctor chamber and the return flow pump, and an ink tempering element arranged in the primary drainage line, the conveyance system providing an adjustment circuit for an adjustment mode (I) and a production circuit for a production mode (II), and being configured for switching into the adjustment mode (I) and the production mode (II), with, in the adjustment mode (I), the conveyance of the ink into the doctor chamber being prevented via use of the bypass line and an automatic adjustment of the operating parameter being performed, and in the production mode (II), the conveyance system conveying the ink into the doctor chamber, the color system including a monitoring element to monitor the operating parameter in the adjustment mode (I) and in the production mode (II), with the monitoring element being arranged in the primary supply line, and the conveyance system including an operating modifier supply station, said method comprising the steps of:

switching the conveyance system from the production mode (II) to the adjustment mode (I), and from the adjustment mode (I) to the production mode (II), including, in the adjustment mode (I), based on the automatic adjustment of the operating parameter, blocking via use of the bypass line, an influx of the ink into the doctor chamber, and in the production mode (II), conveying the ink into the doctor chamber;

monitoring the operating parameter with the monitoring element that measures and/or determines a viscosity of the ink and/or a temperature of the ink, with the monitoring being performed in the adjustment mode (I) and in the production mode (II); and introducing an operating modifier into the adjustment circuit in order to adjust and/or change the monitored operating parameter.

10. The method according to claim 9, wherein the production circuit and the adjustment circuit are operable separately from each other.

11. The method according to claim 9, wherein the operating parameter is the viscosity of the ink, which is adjusted in the adjustment mode (I).

12. The method according to claim 9, wherein the operating modifier is introduced into the adjustment circuit when a target value of the operating parameter is not detected by the monitoring element.

13. The method according to claim 12, wherein the operating modifier is supplied to the primary drainage line, and a mixing of the operating modifier with the ink is performed in the ink reservoir.

14. The method according to claim 9, further comprising a step of introducing a cleaning solution for cleaning the color system into the conveyance system via a cleaning device.

15. The method according to claim 9, wherein the step of switching the conveyance system is effected with a plurality of valves, including a first valve positioned in the primary supply line between the bypass line and the doctor chamber, a second valve positioned in the bypass line, and a third valve positioned in the primary drainage line between the doctor chamber and the bypass line.

* * * * *